US009755363B2

(12) United States Patent
Suzuki et al.

(10) Patent No.: US 9,755,363 B2
(45) Date of Patent: Sep. 5, 2017

(54) CONNECTOR ASSEMBLY

(71) Applicant: Sumitomo Wiring Systems, Ltd., Yokkaichi, Mie (JP)

(72) Inventors: Masakazu Suzuki, Mie (JP); Kazuo Nakai, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/403,245

(22) Filed: Jan. 11, 2017

(65) Prior Publication Data

US 2017/0214179 A1 Jul. 27, 2017

(30) Foreign Application Priority Data

Jan. 27, 2016 (JP) ..... 2016-013317

(51) Int. Cl.

| | |
|---|---|
| ***H01R 13/64*** | (2006.01) |
| ***H01R 13/631*** | (2006.01) |
| ***H01R 13/453*** | (2006.01) |
| *H01R 107/00* | (2006.01) |

(52) U.S. Cl.

CPC ..... *H01R 13/631* (2013.01); *H01R 13/4538* (2013.01); *H01R 2107/00* (2013.01)

(58) Field of Classification Search

CPC .. H01R 13/629; H01R 13/631; H01R 13/453; H01R 13/4538; H01R 2107/00

USPC ..... 439/350, 357, 374

See application file for complete search history.

(56) References Cited

U.S. PATENT DOCUMENTS 5,334,032 A * 8/1994 Myers ..... H01R 13/523 439/140
5,466,164 A * 11/1995 Miyazaki ..... H01R 13/5213 439/140
5,501,606 A * 3/1996 Oda ..... H01R 13/631 439/140

FOREIGN PATENT DOCUMENTS

JP 2007-317442 12/2007

* cited by examiner

*Primary Examiner* — Khiem Nguyen
(74) *Attorney, Agent, or Firm* — Gerald E. Hespos; Michael J. Porco; Matthew T. Hespos

(57) ABSTRACT

A male housing of a connector assembly has moving plate (30) with a pair of resilient locking pieces (34) that can be curved resiliently and deformed to incline a projecting direction of the resilient locking pieces (34). A female housing (50) causes the moving plate (30) to interfere with initial position holding projections (18) and pulls the moving plate (30) back to an initial position by locking with locking portions (55) to the resilient locking pieces (34). The initial position holding projections (18) are paired and spaced apart in the same direction as a separating direction of the resilient locking pieces (34) and are arranged at positions different from the resilient locking pieces (34) in the separating direction of the resilient locking pieces (34).

5 Claims, 14 Drawing Sheets

CONNECTOR ASSEMBLY

BACKGROUND

1. Field of the Invention

The invention relates to a connector assembly.

2. Description of the Related Art

Japanese Unexamined Patent Publication No. 2007-317442 discloses a connector with a male housing that includes a receptacle. Male terminal fittings are mounted in the male housing and a moving plate is accommodated in the receptacle to position tabs of the male terminal fittings. The moving plate moves from an initial position to a connection position as a female housing is inserted into the receptacle in a connecting direction.

Initial position holding projections are formed on an inner wall of the receptacle so that the moving plate at the initial position does not drop to the connection position. Further, the moving plate has a resiliently deformable wall. When the female housing is separated out of the receptacle from a state where the two housings are connected, the female housing pulls the moving plate back to the initial position from the connection position by being locked to the wall.

While the female housing is pulling the moving plate back to the initial position, the moving plate reaches the initial position by passing through the initial position holding projections. However, if the moving plate is caught by the initial position holding projections, the wall may deform resiliently and removed from the female housing and may be impossible to return the moving plate to the initial position. As a countermeasure against this, it is considered to increase a locking margin between the wall and the female housing. However, this increases resistance in moving the moving plate from the initial position toward the connection position, thereby reducing connection operability.

The invention was completed based on the above situation and aims to return a moving plate reliably to an initial position without reducing operability.

SUMMARY

One aspect of the invention relates to a connector assembly that comprises a male housing having male terminal fittings mounted therein. A receptacle is formed on the male housing and at least partly surrounds tabs of the male terminal fittings. A moving plate is accommodated in the receptacle to position the tabs and is movable between an initial position and a connection position. Initial position holding projections are formed on an inner wall of the receptacle and restrict a dropping of the moving plate from the initial position to the connection position. The connector assembly further comprises a female housing that is configured to be connected to and separated from the male housing by moving substantially parallel to the moving plate in the receptacle. Resiliently deformable locking pieces are formed on the moving plate and project substantially parallel to a moving direction of the moving plate. Locks are formed in the female housing and lock to the resilient locking pieces. Thus, the locks enable the female housing to cause the moving plate at the connection position to interfere with the lock and pull the moving plate back to the initial position. The moving plate can curve and deform resiliently to incline a projecting direction of the resilient locking pieces. Additionally, the initial position holding projections are at positions different from the resilient locking pieces in a separating direction of the resilient locking pieces.

Two of the resilient locking pieces may project substantially parallel to a moving direction of the moving plate from positions separated in a direction intersecting the moving direction of the moving plate.

The initial position holding projections may be at positions different from the resilient locking pieces in a separating direction of the resilient locking pieces and may be spaced apart in the same direction as the separating direction of the resilient locking pieces.

The resilient locking pieces may be closer to end sides than the initial position holding projections in the separating direction of the resilient locking pieces. Resilient locking pieces that are closer to the end parts will incline more when the moving plate is curved. Thus, positioning the resilient locking pieces closer to end sides than the initial position holding projections in the separating direction of the resilient locking pieces decreases the locking margins between the resilient locking pieces and the locks when the moving plate is curved.

Two resilient locking pieces may be arranged substantially symmetrically and two initial position holding projections may be arranged substantially symmetrically in the separating direction of the resilient locking pieces. Accordingly, the moving plate is not deformed in a wave-like manner when being curved and has a large curvature. As a result, the resilient locking pieces incline more when the moving plate is curved and this decreased inclination increases the locking margins between the resilient locking pieces and the locks of the female housing.

Retaining projections may be formed on an inner wall of the receptacle and may be configured to restrict a displacement of the moving plate at the initial position in a direction to be separated out of the receptacle. The retaining projections may be arranged at positions different from the resilient locking pieces in a separating direction of the resilient locking pieces and may be spaced apart in the same direction as the separating direction of the resilient locking pieces.

The initial position holding projections may be at positions different from the resilient locking pieces in a separating direction of the resilient locking pieces and may be spaced apart in the same direction as the separating direction of the resilient locking pieces. Two resilient locking pieces may be arranged substantially symmetrically and two initial position holding projections may be arranged substantially symmetrically in the separating direction of the resilient locking pieces.

The female housing pulls the moving plate from the connection position back to the initial position with the locks thereof locked to the resilient locking pieces. This interference of the moving plate with the initial position holding projections causes the moving plate to receive a pulling force from the male housing via the resilient locking pieces at positions different from interfering positions with the initial position holding projections. Then, by the principle of leverage, the moving plate is curved. This curving increases locking margins of the resilient locking pieces with the locks of the female housing. Thus, the moving plate passes over the initial position holding projections and returns to the initial position without being disengaged from the locks.

These and other features of the invention will become more apparent from the following detailed description and accompanying drawings. It should be understood that, even though embodiments are described separately, single features thereof may be combined to additional embodiments.

DETAILED DESCRIPTION

Figure 1:
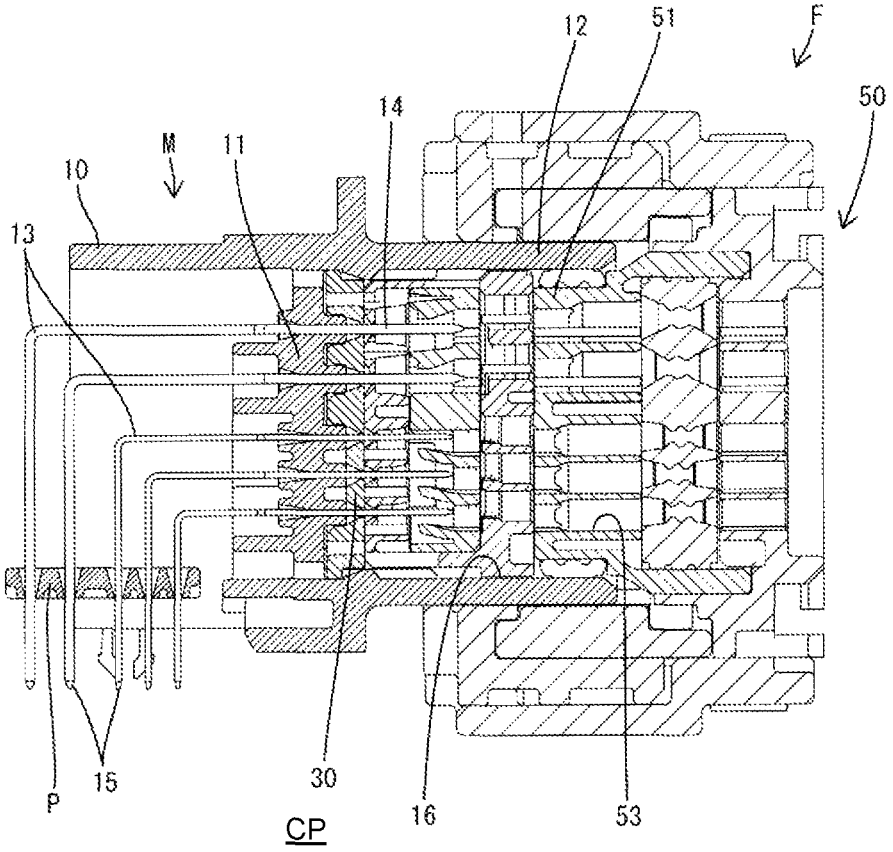
FIG. 1 is a side view in section showing a state where a male housing and a female housing are connected in a connector assembly of one embodiment.
Figure 2:
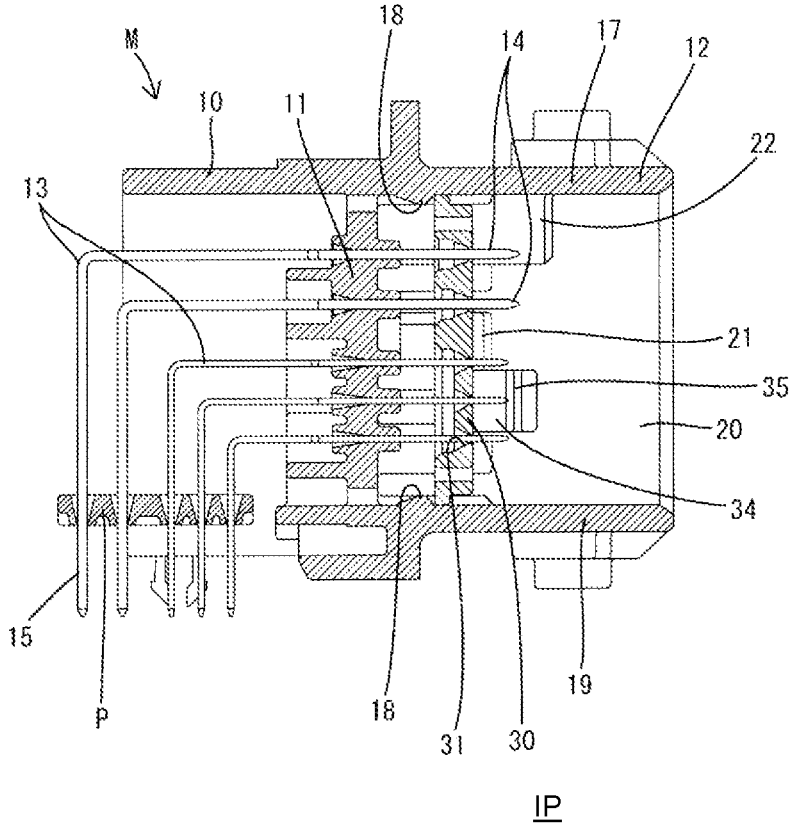
FIG. 2 is a side view in section showing a state where a moving plate is held at an initial position in the male housing.

One specific embodiment of the invention is described with reference to FIGS. 1 to 14. It should be noted that, in the following description, a right side in FIGS. 1 and 2 is defined as the front concerning a front-back direction. Upper and lower sides shown in FIGS. 1 to 5 are defined as upper and lower sides concerning the vertical direction. Left and right sides shown in FIGS. 3 to 6 are defined as left and right sides concerning a lateral direction. A connector assembly A of this embodiment includes a male connector M to be mounted on a circuit board P, as shown in FIGS. 1 and 2, and a female connector F connectable to and separable from the male connector M, as shown in FIG. 1.

<Male Connector M>

Figure 3:
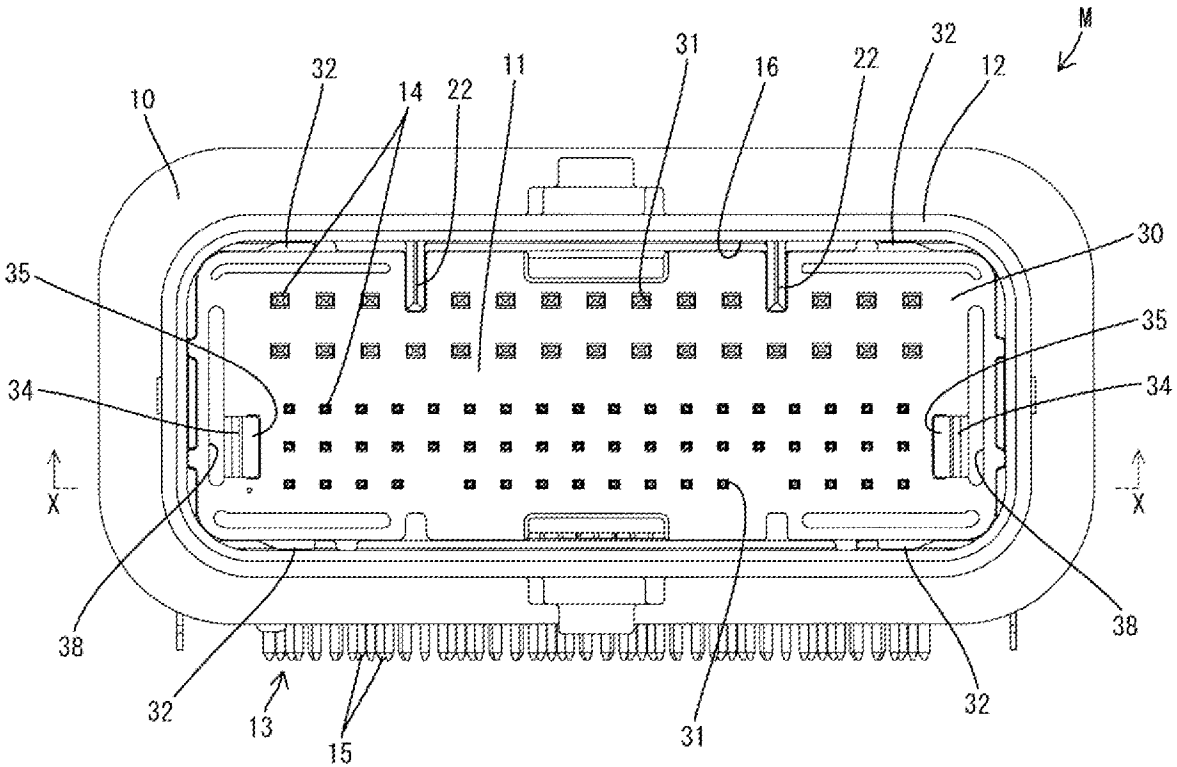
FIG. 3 is a front view of the male housing.
Figure 4:
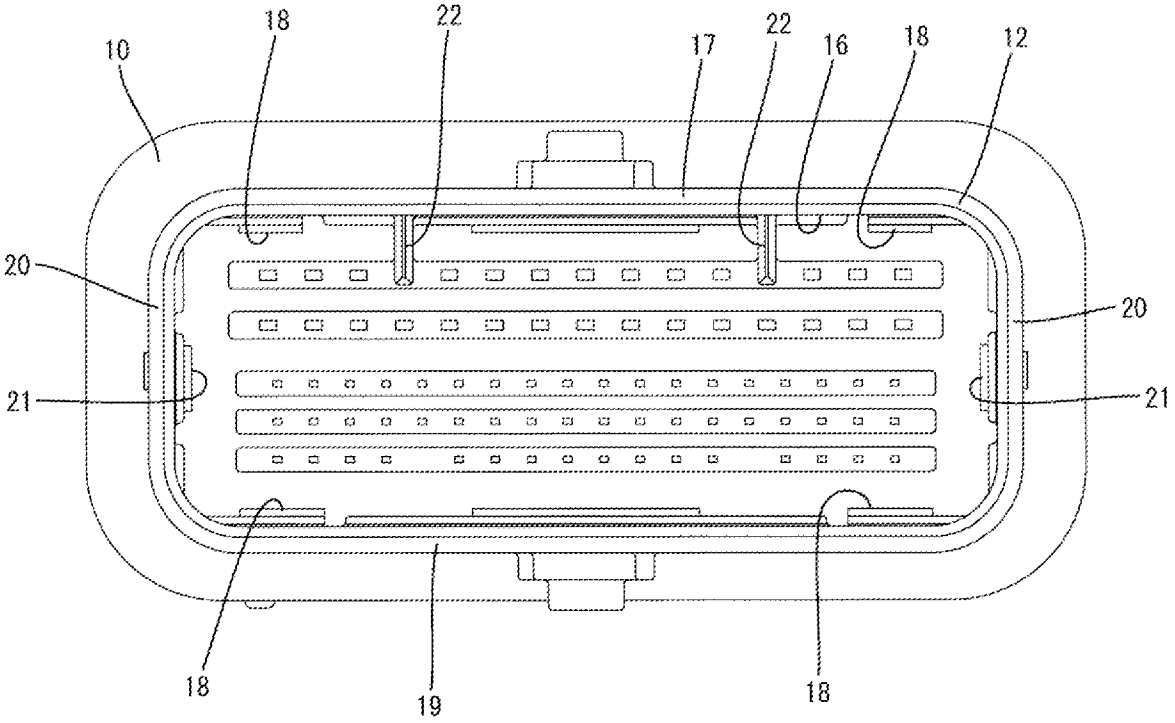
FIG. 4 is a front view showing a state where the moving plate is removed in the female housing.

The male connector M includes a male housing 10 made e.g. of synthetic resin, male terminal fittings 13 and a moving plate 30 e.g. made of synthetic resin. The male housing 10 includes a wall-like terminal holding portion 11 and a receptacle 12 in the form of a substantially rectangular or polygonal tube projecting forward from the terminal holding portion 11. As shown in FIGS. 3 and 4, the terminal holding portion 11 and the receptacle 12 have a substantially rectangular or polygonal shape long in the lateral direction in a front view.

The long and narrow male terminal fittings 13 are held in the terminal holding portion 11. Each male terminal fitting 13 is bent into a substantially L shape in a side view and comprises a tab 14 extending in the front-back direction through the terminal holding portion 11 and a board connecting portion 15 extending substantially perpendicularly down from the rear end of the tab 14 for connection to the circuit board P. Parts of the tabs 14 projecting forward from the terminal holding portion 11 are collectively surrounded by the receptacle 12. A space inside the receptacle 12 serves as an operation space 16 for connecting the female connector F and moving the moving plate 30.

As shown in FIG. 4, two bilaterally symmetrical initial position holding projections 18 are formed on the inner surface (lower surface facing the operation space 16) of an upper wall 17 of the receptacle 12. The initial position holding projections 18 project at positions slightly closer to a center than both ends of the upper wall 17 in the lateral direction. Similarly, two bilaterally symmetrical initial position holding projections 18 are formed on the inner surface (upper surface facing the operation space 16) of a lower wall 19 of the receptacle 12. The initial position holding projections 18 project at positions slightly closer to the center than both ends of the upper wall 17 in the lateral direction. The left initial position holding projection 18 on the upper wall 17 and the left initial position holding projection 18 on the lower wall 19 are at the same positions in the lateral direction. Further, the right initial position holding projection 18 on the upper wall 17 and the right initial position holding projection 18 on the lower wall 19 also are at the same position in the lateral direction.

Two substantially bilaterally symmetrical retaining projections 21 are formed on the inner surfaces (surfaces facing the operation space 16) of both left and right side walls 20 constituting of the receptacle 12. The retaining projections 21 are arranged at a central position in the vertical direction. The retaining projections 21 are arranged in outermost end parts of the operation space 16 in the lateral direction. Thus, the initial position holding projections 18 spaced apart in the lateral direction are located closer to a central side than the pair of retaining projections 21 in the lateral direction. Further, all the initial position holding projections 18 are located more backward (closer to the back of the receptacle 12) than the retaining projections 21.

As shown in FIGS. 1 to 4, the upper wall 17 is formed with two bilaterally symmetrical ribs 22 project down from the inner surface of the upper wall 17. The ribs 22 function to guide the moving plate 30 and the female connector F moving forward and backward in the operation space 16 and function to restrict the accommodation of the moving plate 30 and the female connector F in an improper orientation into the operation space 16.

Figure 5:
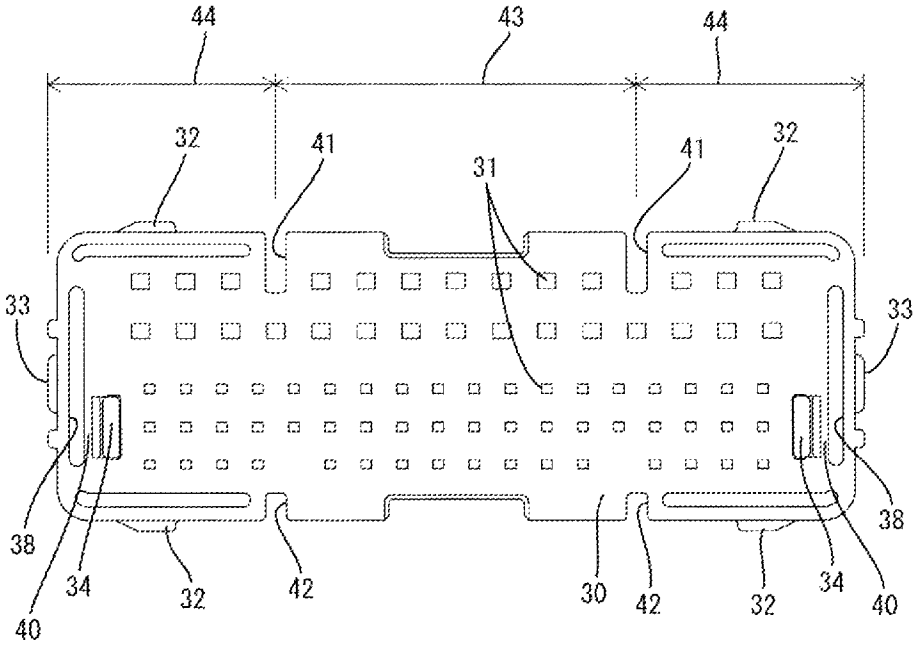
FIG. 5 is a front view of the moving plate.
Figure 6:
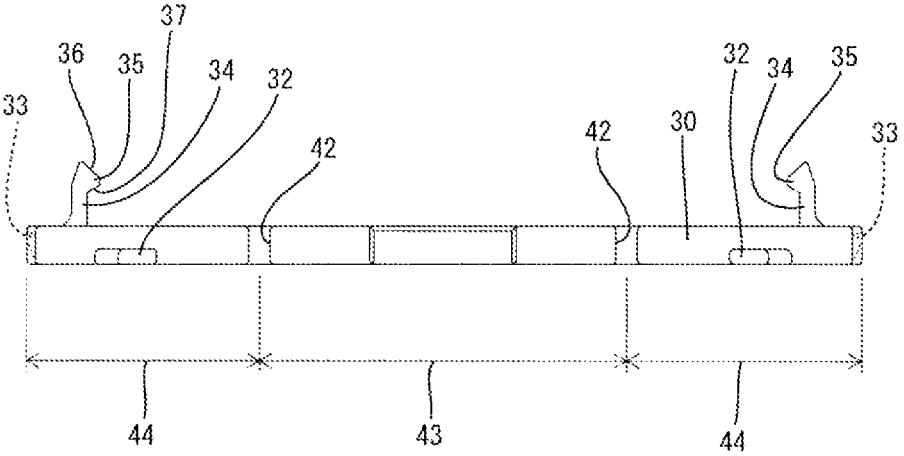
FIG. 6 is a bottom view of the moving plate.

As shown in FIG. 5, the moving plate 30 is a substantially rectangular plate with plate surfaces at a substantially right angle to the front-back direction. The moving plate 30 can move parallel to the front-back direction in the receptacle 12 (operation space 16) with the tabs 14 of the male terminal fittings 13 positioned in the vertical and lateral directions. The moving plate 30 is formed with positioning holes 31 through which the respective tabs 14 are passed. The plurality of tabs 14 are positioned in the vertical and lateral directions by being fit into the positioning holes 31.

Two bilaterally symmetrical holding protrusions 32 are formed on an upper edge part of the outer peripheral edge of the moving plate 30 and two bilaterally symmetrical holding protrusions 32 are formed on a lower edge part of the outer peripheral edge of the moving plate 30. The holding protrusions 32 are arranged at substantially at the same positions as the initial position holding projections 18 in the lateral direction. The left holding protrusion 32 on the upper edge part and the left holding protrusion 32 on the lower edge part are at the same position in the lateral direction. The right holding protrusion 32 on the upper edge part and the right holding protrusion 32 on the lower edge part also are arranged at the same position in the lateral direction.

Two substantially bilaterally symmetrical retaining protrusions 33 are formed on left and right side edges of the outer periphery of the moving plate 30. The retaining protrusions 33 are arranged at a central position in the vertical direction. The retaining protrusions 33 are at outermost end parts of the moving plate 30 in the lateral direction so as to correspond to the retaining projections 21 described above. Thus, the laterally spaced holding protrusions 32 are located closer to a central side than the retaining protrusions 33 in the lateral direction.

The moving plate 30 is formed with two resilient locking pieces 34 that are bilaterally symmetrical and cantilevered forward. Each resilient locking piece 34 is substantially in the form of a plate whose plate thickness direction is aligned with the lateral direction. Thus, the resilient locking piece 34 is resiliently deformable in the lateral direction (plate thickness direction). The resilient locking piece 34 is resiliently deformable in a direction substantially orthogonal to a moving direction of the moving plate 30 in the receptacle 12 and a moving direction of the female connector F in the receptacle 12.

Figure 7:
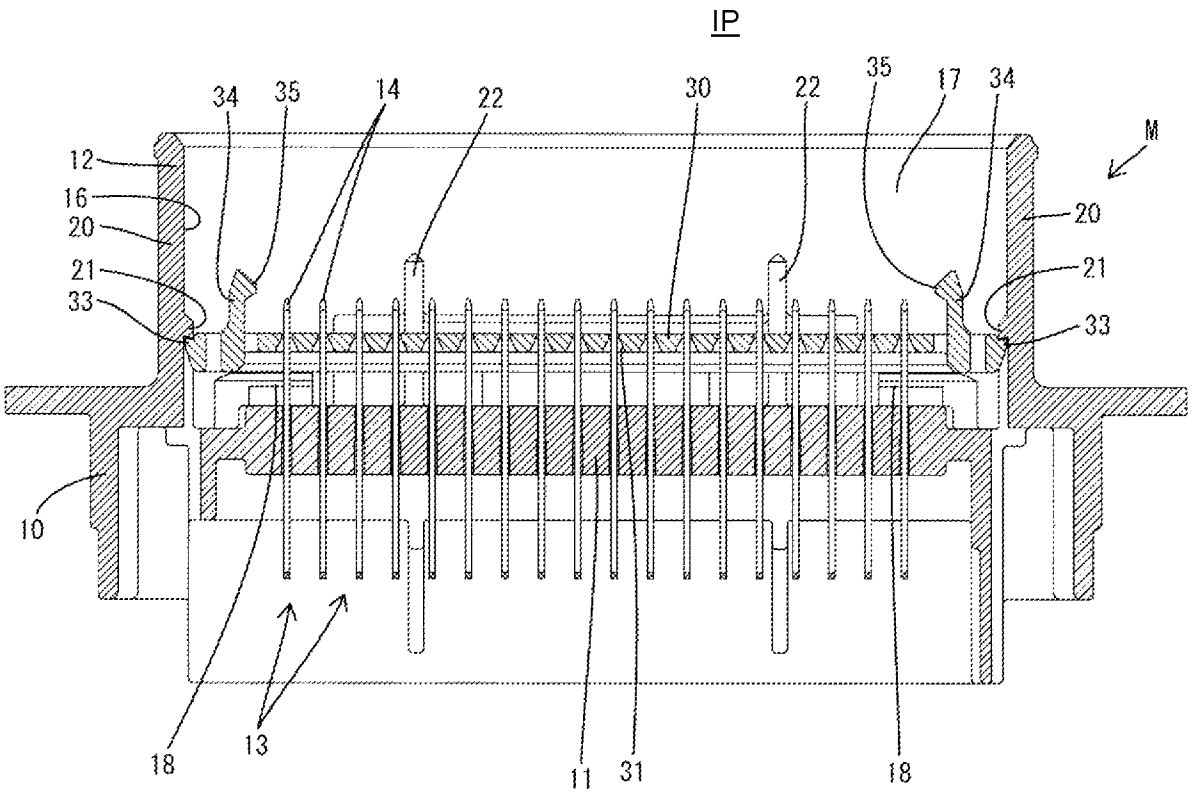
FIG. 7 is a section along X-X of FIG. 3.
Figure 8:
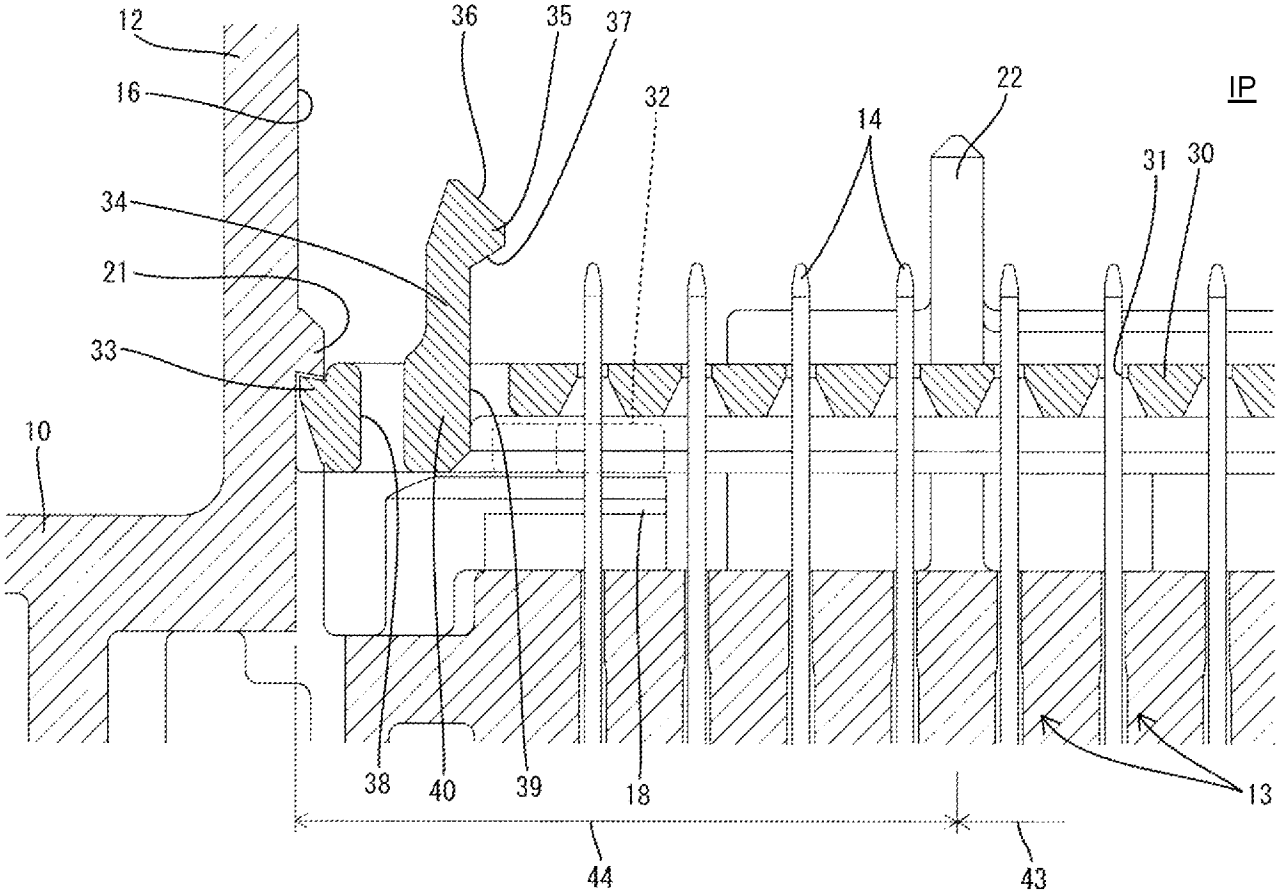
FIG. 8 is a partial enlarged section of FIG. 7.

As shown in FIG. 7, a locking projection 35 projects in and right on an extending end part (front end part) of the left resilient locking piece, and a locking projection 35 projects in or left on an extending end part (front end part) of the right resilient locking piece 34. As shown in FIG. 8, a front tapered surface 36 inclined with respect to the front-back direction is formed on the front surface of the locking projection 35, and a rear tapered surface 37 inclined with respect to the front-back direction is formed on the rear surface of the locking projection 35.

The resilient locking pieces 34 are slightly below a center in the vertical direction and are slightly closer to the center than the lateral ends of the moving plate 30. Specifically, the resilient locking pieces 34 are closer to sides than the laterally spaced holding protrusions 32 and are closer to the center than the laterally spaced retaining protrusions 33. With the moving plate 30 accommodated in the receptacle 12 (operation space 16), the locking projections 35 of the resilient locking pieces 34 are closer to the sides than the laterally spaced initial position holding projections 18 and are closer to the center than the laterally spaced retaining projections 21.

As shown in FIGS. 5 and 8, the moving plate 30 is formed with two bilaterally symmetrical slits 38. Each slit 38 is long and narrow in the vertical direction and penetrates through the moving plate 30 in the front-back direction. Each slit 38 is arranged between the resilient locking piece 34 and the retaining protrusion 33 in the lateral direction. A formation range of each slit 38 in the vertical direction is an area including the resilient locking piece 34. Further, the moving plate 30 is formed with two bilaterally symmetrical mold removal holes 39 penetrating in the front-back direction. The mold removal holes 39 are formed when the locking projections 35 (moving plate 30) is molded, and are in areas corresponding to the locking projections 35 in the lateral and vertical directions (i.e. positions adjacent to the resilient locking pieces 34).

A narrow portion 40 between the slit 38 and the mold removal hole 39 in the moving plate 30 is easily deformed, and a base end of the resilient locking piece 34 is connected to this narrow portion 40. Thus, the resilient locking piece 34 is resiliently deformable in the lateral direction to curve itself and, at the same time, can change its orientation to swing in the lateral direction according to the resilient deformation of the narrow portion 40.

As shown in FIGS. 3 and 5, the moving plate 30 is formed with two substantially bilaterally symmetrical first grooves 41. The first grooves 41 are formed by cutting the moving plate 30 down from the upper edge and can slide in contact with the ribs 22 of the receptacle 12 in the front-back direction. The moving plate 30 also is formed with two substantially bilaterally symmetrical second grooves 42. The second grooves 42 are formed by cutting the moving plate 30 up from the lower edge and are at the same positions as the first grooves 41 in the lateral direction. Vertical lengths of the second grooves 42 are shorter than those of the ribs 22 and the first grooves 41.

The first grooves 41 and the second grooves 42 are at the same positions in the lateral direction, and a vertical dimension of the moving plate 30 is locally reduced in parts where the first and second grooves 41, 42 are formed. Further, the first grooves 41 and the second grooves 42 are at positions closer to the center than the resilient locking pieces 34 in the lateral direction. In this way, the moving plate 30 can be divided into a central area 43 where no resilient locking piece 34 is formed and left and right end side areas 44 where the resilient locking pieces 34 are formed. The formation areas of the first and second grooves 41, 42 define boundaries between these areas.

The plate-shaped moving plate 30 can be curved and deformed resiliently to deflect the front surface concavely (i.e. to bring the locking projections 35 of the resilient locking pieces 34 closer to each other) and also can be curved and deformed resiliently to deflect the rear surface concavely (i.e. to bring the locking projections 35 of the resilient locking pieces 34 away from each other). Further, the formation areas of the first and second grooves 41, 42 easily deform resiliently due to a locally smaller vertical dimension as described above.

The moving plate 30 is accommodated in the receptacle 12 (operation space 16) in a state where the male and female connectors M, F are not connected yet and is held at an initial position, as shown in FIGS. 2, 7 and 8. A backward movement of the moving plate 30 at the initial position toward the back of the receptacle 12 (toward a connection position) is restricted by the contact of the holding protrusions 32 of the moving plate 30 with the initial position holding projections 18 of the receptacle 12 from the front. The contact positions of the initial position holding projections 18 and the holding protrusions 32 are different from the positions of the resilient locking pieces 34 in the lateral direction (direction in which the resilient locking pieces 34 are separated) and are closer to the center than the resilient locking pieces 34 in the lateral direction.

Further, a forward movement of the moving plate 30 at the initial position IP away from the receptacle 12 (toward the connection position) is restricted by the contact of the retaining protrusions 33 of the moving plate 30 with the retaining projections 21 of the receptacle 12 from behind. The contact positions of the retaining projections 21 and the retaining protrusions 33 are different from the positions of the resilient locking pieces 34 in the lateral direction (direction in which the pair of resilient locking pieces 34 are separated) and are closer to the ends than the resilient locking pieces 34 in the lateral direction.

<Female Connector F>

The female connector F includes a female housing 50 and a plurality of female terminal fittings (not shown). The female housing 50 is configured by assembling a housing body 51 e.g. made of synthetic resin and a front retainer 56 e.g. made of synthetic resin and to be mounted on a front surface 52 (rear surface based on the male housing 10) of the housing body 51. The female terminal fittings are accommodated individually in terminal accommodating chambers 53 formed in the housing body 51.

Bilaterally symmetrical locking spaces 54 are formed in left and right ends of the housing body 51. The locking spaces 54 are open on the front surface 52 of the housing body 51 and are at positions corresponding to the resilient locking pieces 34 in the vertical and lateral directions. Bilaterally symmetrical locks 55 are formed in the locking spaces 54.

The front retainer 56 includes a retainer body 57 for covering the front surface 52 of the housing body 51. The retainer body 57 is formed with a plurality of terminal insertion openings 58 corresponding to the respective terminal accommodating chambers 53. When the male connector M and the female connector F are connected, the tabs 14 of the male terminal fittings 13 are inserted through the respective terminal insertion openings 58 and connected to the respective female terminal fittings in the terminal accommodating chambers 53. Similarly, the retainer body 57 is formed with two bilaterally symmetrical communication holes 59 allowing the two locking spaces 54 to communicate with the outside of the female housing 50. Tapered guide edges 60 are formed at positions of opening edges of the communication holes 59 overlapping with (corresponding to) the locks 55 in the lateral and vertical directions.

<Connection of Male Connector M and Female Connector F>

Connection of the female connector F to the male housing 10 is started by inserting the female connector F into the receptacle 12 with the moving plate 30 held at the initial position IP. In the insertion process, the guide edges 60 of the front retainer 56 contact the front tapered surfaces 36 of the resilient locking pieces 34 to press the moving plate 30 back. However, the moving plate 30 does not move back because the holding protrusions 32 thereof are locked to the initial position holding projections 18. Thus, as the female connector F is inserted, the resilient locking pieces 34 are deformed resiliently in the lateral direction due to the inclination of the front tapered surfaces 36 and the guide edges 60.

Figure 10:
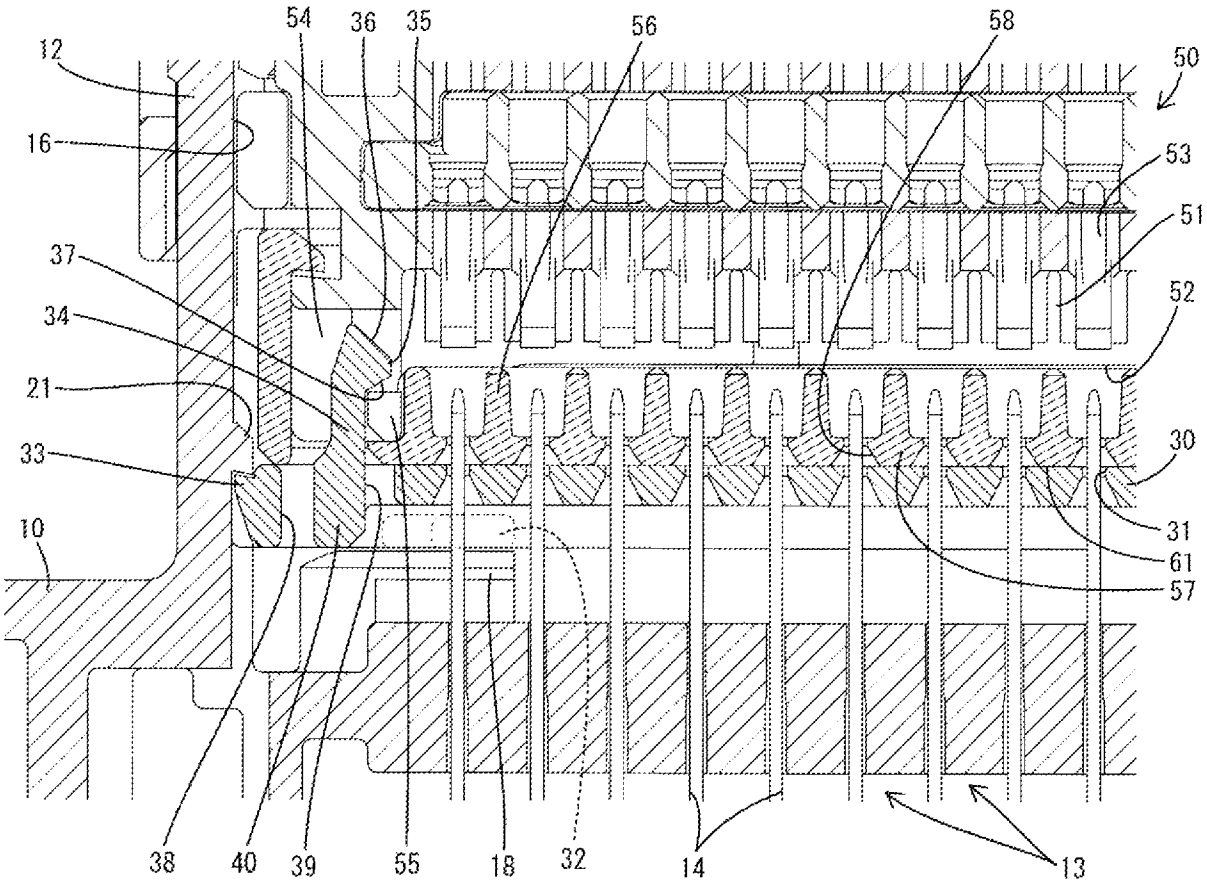
FIG. 10 is a partial enlarged section showing a state where the female housing is locked to the moving plate held at the initial position.

When the female housing 50 becomes locked properly to the moving plate 30, as shown in FIG. 10, a front surface 61 of the front retainer 56 contacts the front surface of the moving plate 30, the locking projections 35 of the resilient locking pieces 34 are inserted into the locking spaces 54, the resilient locking pieces 34 resiliently restore and the rear tapered surfaces 37 are locked to the locks 55 from the front. This locking between the rear tapered surfaces 37 and the locks 55 restricts a backward displacement of the moving plate 30 relative to the female housing 50.

Figure 9:
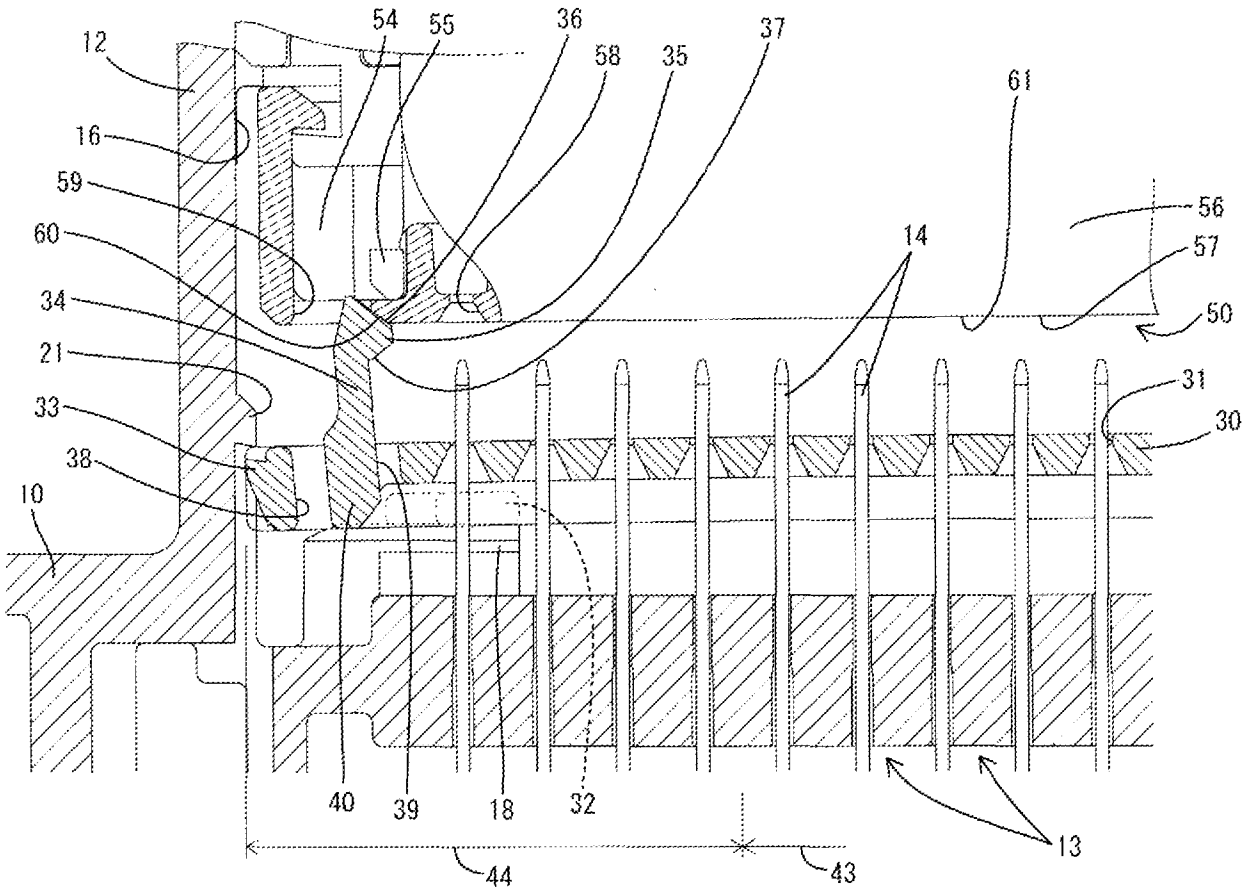
FIG. 9 is a partial enlarged section showing the process of locking the female housing to the moving plate.

The resilient locking pieces 34 enter the locking spaces 54 while being resiliently deformed. As a result, the guide edges 60 laterally press the front tapered surfaces 36 at positions closer to the sides than the locked positions of the initial position holding projections 18 and the holding protrusions 32. Thus, by the principle of leverage, the moving plate 30 resiliently curves and deforms to deflect the rear surface thereof concavely. At this time, the side areas 44 are displaced back (down in FIG. 9) with respect to the central area 44. The resilient locking pieces 34 project forward from the side areas 44 and laterally incline as the moving plate 30 is curved, as shown in FIG. 9. With this inclination, the locking projections 35 (front tapered surfaces 36) displace away from the guide edges 60 in the lateral direction. Therefore, locking margins between the locking projections 35 and the tapered surfaces decrease in the lateral direction.

The amount of resilient deformation of the resilient locking pieces 34 necessary for the front tapered surfaces 36 to pass through the locking projections 35 is reduced by the inclination of the resilient locking pieces 34 and resilient restoring forces of the resilient locking pieces 34 are reduced. That is, operability is satisfactory since resistance due to the resilient restoring forces of the resilient locking pieces 34 is reduced when the female connector F is locked to the moving plate 30 while resiliently deforming the resilient locking pieces 34.

Figure 11:
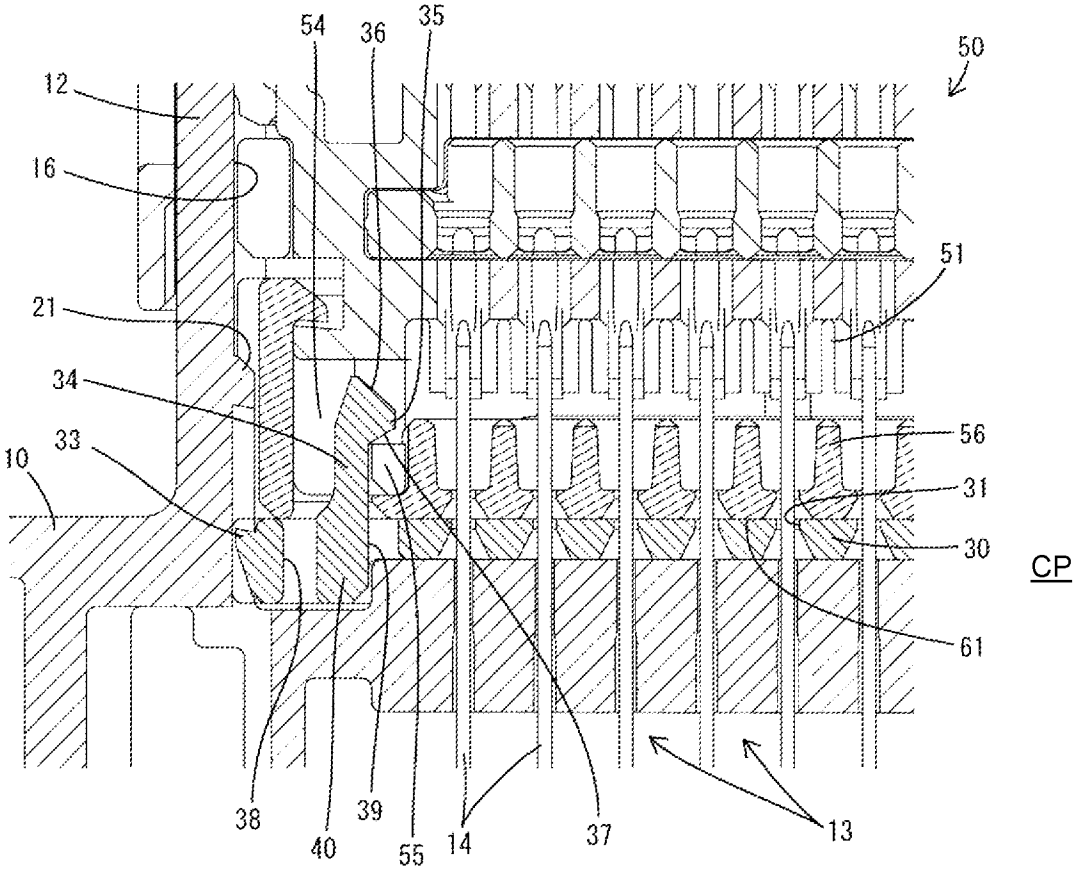
FIG. 11 is a partial enlarged section showing a state where the female housing and the male housing are connected.

The female connector F is fit further to press the moving plate 30 from a state where the female connector F is locked to the moving plate 30. As a result, the moving plate 30 deforms resiliently, the holding protrusions 32 disengage from the initial position holding projections 18 and the moving plate 30 at the initial position IP moves toward the connection position CP (back side of the receptacle 12) integrally with the female connector F. The connection position CP is reached, as shown in FIGS. 1 and 11, and the connectors F, M (both housings 10, 50) are connected properly when the front surface of the moving plate 30 contacts the back end surface of the receptacle 12 (front surface of the terminal holding portion 11).

<Separation of Male Connector M and Female Connector F>

Figure 12:
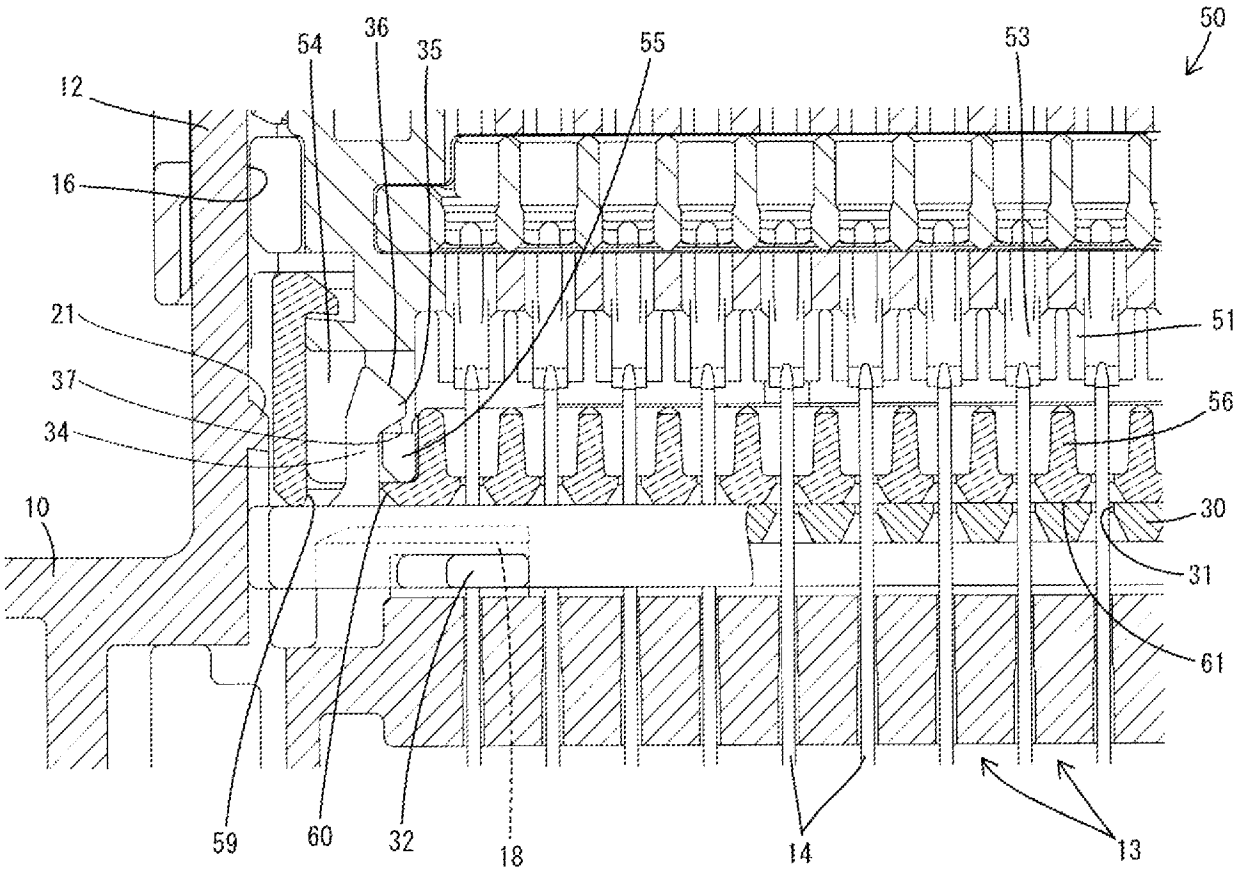
FIG. 12 is a partial enlarged section showing a state where the moving plate comes into contact with an initial position holding projection while the female housing is pulling the moving plate back to the initial position.

In separating the connectors F, M connected to each other, the female connector F is pulled forward away from the male connector M. At this time, the locks 55 of the female connector F are locked to the locking projections 35 (rear tapered surfaces 37) of the resilient locking pieces 34 of the moving plate 30. Thus, the moving plate 30 moves toward the initial position (toward the front end of the receptacle 12) together with the female housing 50. While the female housing 50 is pulling the moving plate 30 back to the initial position IP, the holding protrusions 32 of the moving plate 30 come into contact with the initial position holding projections 18 of the receptacle 12 from behind, as shown in FIG. 12 to restrict movement of the moving plate 30 toward the initial position IP. Thus, the resilient locking pieces 34 are resiliently deformed in directions to disengage the locking projections 35 from the locks 55 by the inclination of the rear tapered surfaces 37.

Figure 13:
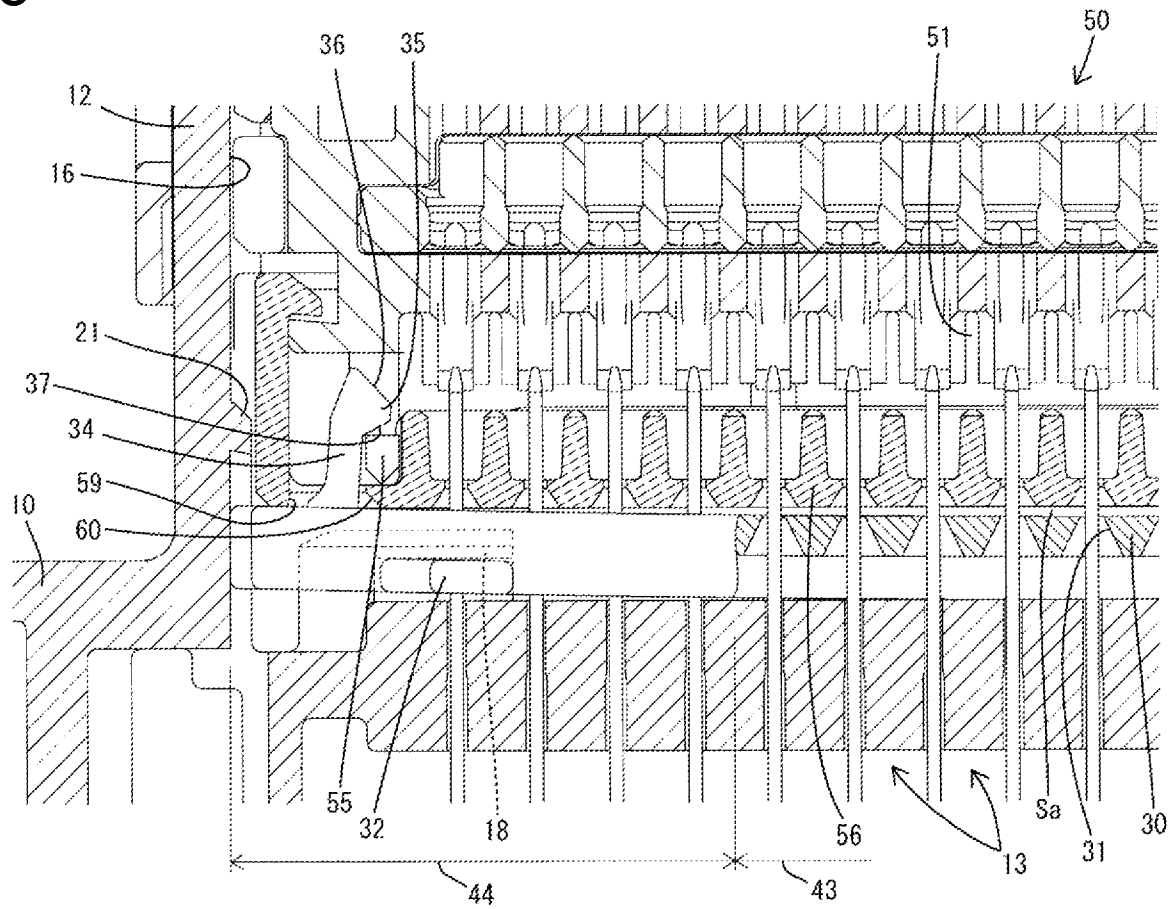
FIG. 13 is a partial enlarged section showing a state where the moving plate starts moving over the initial position holding projection while the female housing is pulling the moving plate back to the initial position.

However, the locks 55 are locked to the resilient locking pieces 34 at the positions closer to the ends than the contact positions of the initial position holding projections 18 and the holding protrusions 32 in the lateral direction. Thus, by the principle of leverage, the moving plate 30 is curved resiliently and deformed to deflect the front surface thereof concavely. At this time, the end areas 44 are displaced more forward (up in FIG. 13) than the central area 43. Thus, a clearance Sa is formed between the front surface of the moving plate 30 and the front surface 61 of the female housing 50. This clearance Sa is larger in the central area 43 than in the end side areas 44 of the moving plate 30. The resilient locking pieces 34 project forward from the side areas 44 and incline laterally as the moving plate 30 is curved, as shown in FIG. 13.

With this inclination, locking margins between the locking projections 35 and the locks 55 in the lateral direction increase and it becomes difficult to disengage the locks 55 and the rear tapered surfaces 37 (locking projections 35) since the locking projections 35 (rear tapered surfaces 37) are displaced to approach the locks 55 in the lateral direction. In this way, the holding protrusions 32 pass through the initial position holding projections 18 with the resilient locking pieces 34 of the moving plate 30 and the locking portions 55 of the female housing 50 locked to each other. In this way, the moving plate 30 is pulled reliably back to the initial position IP by the female housing 50.

The curved and deformed moving plate 30 is restored resiliently when the holding protrusions 32 pass through the initial position holding projections 18. Further, the holding protrusions 32 that pass through the initial position holding projections 18 keep the locks 55 locked to the locking projections 35 (rear tapered surfaces 37) and pull the resilient locking pieces 34. Thus, the moving plate 30 is pulled forward by the female housing 50. However, the retaining protrusions 33 are locked to the retaining projections 21 to restrict any further forward displacement of the moving plate 30. Thus, as the female connector F is separated, the resilient locking pieces 34 are deformed resiliently in the lateral direction by the inclination of the rear tapered surfaces 37 and disengaged from the locks 55.

At this time, the locks 55 pull the locking projections 35 at the positions closer to the central side than the locked positions of the retaining projections 21 and the retaining protrusions 33 in the lateral direction. Thus, by the principle of leverage, the moving plate 30 is curved resiliently and deformed to deflect the rear surface thereof concavely. At this time, the end side areas 44 are displaced more backward (down in FIG. 14) than the central area 43 and a clearance Sb is formed between the front surfaces of the end side areas 44 of the moving plate 30 and the front surface 61 of the female housing 50.

Figure 14:
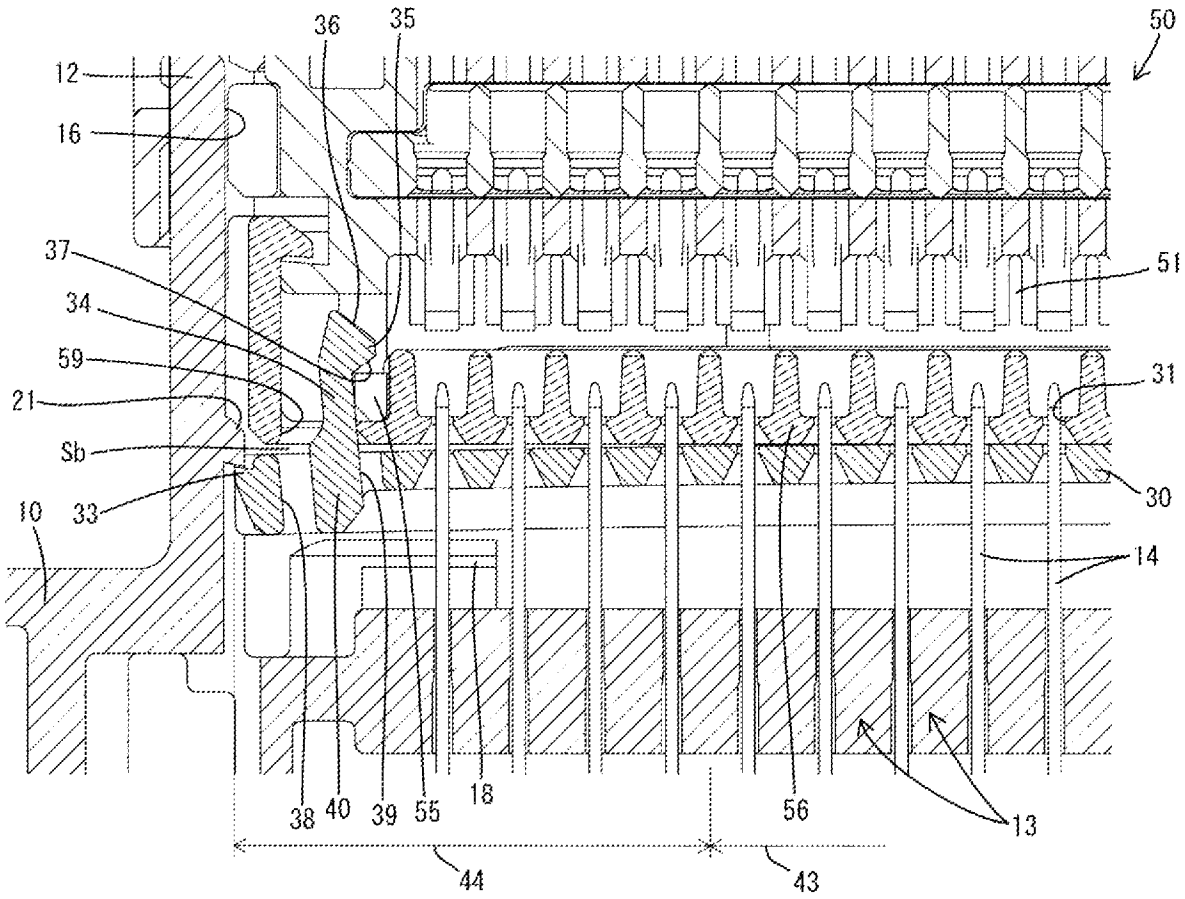
FIG. 14 is a partial enlarged section showing a state where the female housing starts being separated from the moving plate held at the initial position.

The resilient locking pieces 34 project forward from the end side areas 44 and incline laterally as the moving plate 30 is curved, as shown in FIG. 14. With this inclination, the locking margins between the locking projections 35 and the locks 55 in the lateral direction decrease since the locking projections 35 (rear tapered surfaces 37) are displaced away from the locks 55 in the lateral direction. Accordingly, the amount of resilient deformation of the resilient locking pieces 34 necessary for the locks 55 to pass through the locking projections 35 is reduced by the inclination of the resilient locking pieces 34. This causes resilient restoring forces of the resilient locking pieces 34 to be reduced. Accordingly, operability is satisfactory since resistance due to the resilient restoring forces of the resilient locking pieces 34 is reduced when the female connector F is separated from the moving plate 30 while resiliently deforming the resilient locking pieces 34.

Functions and Effects of Embodiment

The male connector M includes the male housing 10, the receptacle 12 and the moving plate 30. The male housing 10 has the male terminal fittings 13 mounted therein. The receptacle 12 is formed on the male housing 10 and at least partly surrounding the tabs 14 of the male terminal fittings 13. The moving plate 30 is accommodated in the receptacle 12 while positioning the tabs and is movable between the initial position IP and the connection position CP. The initial position holding projections 18 formed on the inner wall of the receptacle 12 are configured to restrict the displacement of the moving plate at the initial position IP to the connection position CP. The female connector F (female housing 50) is connected to and separated from the male housing 10 by moving parallel to and integrally with the moving plate 30 in the receptacle 12.

The resilient locking pieces 34 project forward from the moving plate 30 in directions substantially parallel to the moving direction of the moving plate 30 from positions separated in the lateral direction, which intersects the moving direction. The resilient locking pieces 34 are resiliently deformable in the lateral direction. On the other hand, the female housing 50 is formed with the locks 55 that enable the female housing 50 to pull the moving plate 30 at the connection position CP back to the initial position IP by being locked to the resilient locking pieces 34. Each lock 55 is displaceable from the position where the lock 55 is not locked to the resilient locking piece 34 (position in front of the resilient locking piece 34) to the position locked to the resilient locking piece 34 (position where the lock 55 is locked to the locking projection 35 from behind) by resiliently deforming the resilient locking piece 34.

Further, the moving plate 30 is curved resiliently and deformed to incline the projecting direction of the resilient locking pieces 34 in the lateral direction. The initial position holding projections 18 are arranged in pairs to be spaced apart in the lateral direction, i.e. in the same direction as the separating direction of the resilient locking pieces 34. The pairs of the initial position holding projections 18 are at positions different from the resilient locking pieces 34 in the separating direction (lateral direction) of the resilient locking pieces 34.

According to this configuration, the female housing 50 is inserted into the receptacle 12 with the moving plate 30 locked at the initial position IP by the initial position holding projections 18. Thus, the locks 55 press the locking projections 35 of the resilient locking pieces 34. At this time, the moving plate 30 receives a pressing force from the female housing 50 via the resilient locking pieces 34 at the positions different from the contact positions with the initial position holding projections 18. Then, by the principle of leverage, the moving plate 30 is curved. The resilient locking pieces 34 are inclined by this curving so that the locking margins of the resilient locking pieces 34 with the locks 55 decrease and the amount of resilient deformation of the resilient locking pieces 34 when the locks 55 reach the locked positions (positions where the locking portions 55 are locked to the rear tapered surfaces 37) decreases. Thus, operability is improved since resistance due to resilient restoring forces of the resilient locking pieces 34 is reduced when the female housing 50 is locked to the moving plate 30.

Resilient locking pieces 34 that are closer to the ends of the moving plate 30 will incline more when the moving plate 30 is curved. Focusing on this point, the resilient locking pieces 34 are closer to the ends than the initial position holding projections 18 in the separating direction of the resilient locking pieces 34. This causes the resilient locking pieces 34 to incline more when the moving plate 30 is curved and the locking margins between the resilient locking pieces 34 and the locks 55 of the female housing 50 decrease to improve operability in locking the female housing 50 to the moving plate 30.

The resilient locking pieces 34 are arranged substantially symmetrically in their separating direction and the initial position holding projections 18 also are arranged substantially symmetrically. Accordingly, the moving plate 30 is not deformed in a wave-like manner when being curved and, hence, has a large curvature. Thus, the locking margins between the resilient locking pieces 34 and the locking portions 55 of the female housing 50 decrease and operability in locking the female housing 50 to the moving plate 30 is improved.

The female housing 50 of the female connector F is formed with the locks 55. The locks 55 enable the female housing 50 to cause the moving plate 30 at the connection position to interfere with the initial position holding projections 18 and pull the moving plate 30 back to the initial position IP by being locked to the resilient locking pieces 34. In addition, the moving plate 30 is made capable of being curved and deformed resiliently to incline the projecting direction of the resilient locking pieces 34 in the lateral direction. The initial position holding projections 18 are arranged in pairs while being spaced apart in the lateral direction, i.e. in the same direction as the separating direction of the resilient locking pieces 34, and are at positions different from the resilient locking pieces 34 in the separating direction of the resilient locking pieces 34.

Accordingly, the female housing 50 pulls the moving plate 30 back to the initial position, and causes the moving plate 30 to interfere with the initial position holding projections 18. At this time, the moving plate 30 receives a pulling force from the female housing 50 via the resilient locking pieces 34 at positions different from interfering positions with the initial position holding projections 18. Then, by the principle of leverage, the moving plate 30 curves and the resilient locking pieces 34 are inclined by this curving. Thus, the locking margins of the resilient locking pieces 34 with the locks 55 of the female housing 50 increase. This causes the moving plate 30 to pass through the initial position holding projections 18 without being disengaged from the locks 55 and return to the initial position IP.

Resilient locking pieces 34 that are closer to the end parts incline more when the moving plate 30 is curved. Focusing on this point, the resilient locking pieces 34 are closer to the sides than the initial position holding projections 18 in the separating direction of the resilient locking pieces 34. This causes the resilient locking pieces 34 to incline more when the moving plate 30 is curved and increases the locking margins between the resilient locking pieces 34 and the locks 55 of the female housing 50. Thus, the resilient locking pieces 34 and the locks 55 are kept locked to each other and the moving plate 30 can reliably pass through the initial position holding projections 18.

The resilient locking pieces 34 are arranged substantially symmetrically in their separating direction and the initial position holding projections 18 also are arranged substantially symmetrically. According to this configuration, the moving plate 30 is not deformed in a wave-like manner when being curved and, hence, has a large curvature. This causes the resilient locking pieces 34 to incline more when the moving plate 30 is curved and increases the locking margins between the resilient locking pieces 34 and the locks 55 of the female housing 50. Thus, the disengagement of the resilient locking pieces 34 and the locks 55 is prevented reliably.

The retaining projections 21 are formed on the inner wall of the receptacle 12 of the male connector M and restrict displacement of the moving plate 30 forward from the initial position in the direction to be separated from the receptacle 12. The female housing 50 is formed with the locks 55 that enable the female housing 50 to pull the moving plate 30 from the connection position CP back to the initial position IP by being locked to the resilient locking pieces 34. Each lock 55 is displaceable from the position where the lock 55 is locked to the locking projection 35 of the resilient locking piece 34 from behind to the position where the lock 55 is not locked to the resilient locking piece 34 (position deviated forward from the locking projection 35) by resiliently deforming the resilient locking piece 34.

The moving plate 30 is made capable of being resiliently curved and deformed to incline the projecting direction of the resilient locking pieces 34 in the lateral direction. The initial position holding projections 18 are arranged in pairs while being spaced apart in the lateral direction, i.e. in the same direction as the separating direction of the resilient locking pieces 34, and these pairs of the initial position holding projections 18 are arranged at the positions different from the resilient locking pieces 34 in the separating direction (lateral direction) of the resilient locking pieces 34.

According to this configuration, when the moving plate 30 pulled back to the initial position IP by the female housing 50 contacting the retaining projections 21, the moving plate 30 receives a pulling force from the female housing 50 via the resilient locking pieces 34 at the positions different from the contact positions with the retaining projections 21. Then, by the principle of leverage, the moving plate 30 is curved. The locking margins of the resilient locking pieces 34 with the locks 55 of the female housing 50 decrease by this curving. Thus, the amount of resilient deformation of the resilient locking pieces 34 becomes smaller when the locks 55 reach the positions where the locks 55 are not locked to the resilient locking pieces 34 (positions deviated forward from the locking projections 35). Resistance due to resilient restoring forces of the resilient locking pieces 34 is reduced when the female housing 50 is separated from the moving plate 30 in this way so that operability is improved.

Resilient locking pieces 34 that are closer to the end parts incline more when the moving plate 30 is curved. Focusing on this point, the resilient locking pieces 34 are arranged closer to the sides than the initial position holding projections 18 in the separating direction of the resilient locking pieces 34. This causes the resilient locking pieces 34 to incline more when the moving plate 30 is curved so that the locking margins between the resilient locking pieces 34 and the locks 55 of the female housing 50 decrease. Thus, operability in separating the female housing 50 from the moving plate 30 is improved.

Further, the resilient locking pieces 34 are arranged substantially symmetrically in their separating direction and the initial position holding projections 18 also are arranged substantially symmetrically. According to this configuration, the moving plate 30 is not deformed in a wave-like manner when being curved and, hence, has a large curvature. This causes the resilient locking pieces 34 to incline more when the moving plate 30 is curved so that the locking margins between the resilient locking pieces 34 and the locks 55 of the female housing 50 decrease. In this way, operability in separating the female housing 50 from the moving plate 30 is improved.

The invention is not limited to the above described embodiment. For example, the following embodiments also are included in the scope of the invention.

The resilient locking pieces are closer to the end sides than the initial position holding projections in the above embodiment. However, the resilient locking pieces may be closer to the center than the initial position holding projections. In this case, the projections of the resilient locking pieces have only to project outwardly.

The resilient locking pieces are closer to the center than the retaining projections in the above embodiment. However, the resilient locking pieces may be closer to the ends than the retaining projections. In this case, the projections of the resilient locking pieces only have to project outward.

The resilient locking pieces are arranged symmetrically in the above embodiment. However, there is no limitation to this and the resilient locking pieces may be arranged asymmetrically. In this case, one of the resilient locking pieces may be closer to the end part than the initial position holding projections and the other resilient locking piece may be closer to the center than the initial position holding projections. In this case, the moving plate is curved in a wave-like manner.

The initial position holding projections are arranged symmetrically in the above embodiment. However, the initial position holding projections may be arranged asymmetrically. In this case, one of the resilient locking pieces may be closer to the end part than the initial position holding projections and the other resilient locking piece may be closer to the center than the initial position holding projections. In this case, the moving plate is curved in a wave-like manner.

The retaining projections are arranged symmetrically in the above embodiment. However, the retaining projections may be arranged asymmetrically. In this case, one of the resilient locking pieces may be closer to the end part than the retaining projection and the other resilient locking piece may be closer to the center than the retaining projection. In this case, the moving plate is curved in a wave-like manner.

The locking portions of the female housing are projections in the above embodiment. However, there is no limitation to this and the locking portions of the male housing may be recessed.

The male and female connectors are connected and separated via a lever. However, the invention can also be applied to connectors in which male and female connectors are connected and separated without using a lever.

The male housing is mounted on a circuit board in the above embodiment. However, the male connector need not be mounted on the circuit board.

REFERENCE SIGNS

A . . . connector assembly
M . . . male connector
F . . . female connector
10 . . . male housing
12 . . . receptacle
13 . . . male terminal fitting
14 . . . tab
18 . . . initial position holding projection
21 . . . retaining projection
30 . . . moving plate
34 . . . resilient locking piece
50 . . . female housing
55 . . . lock

What is claimed is:

1. A connector assembly (A), comprising:

a male housing having one or more male terminal fittings mounted therein;

a receptacle formed on the male housing and at least partly surrounding at least one tab of the at least one male terminal fitting;

a moving plate accommodated in the receptacle while positioning the at least one tab and movable between an initial position and a connection position;

at least one initial position holding projection formed on an inner wall of the receptacle and configured to restrict a drop of the moving plate at the initial position to the connection position;

a female housing configured to be connected and separated to and from the male housing by moving substantially parallel to the moving plate in the receptacle;

at least one resilient locking piece formed on the moving plate to project substantially parallel to a moving direction of the moving plate, the at least one resilient locking piece being resiliently deformable; and at least one lock formed in the female housing and enabling the female housing to cause the moving plate at the connection position to interfere with the at least one lock and pull the moving plate back to the initial position by being locked to the at least one resilient locking piece;

wherein:

the moving plate is configured to be resiliently curved and deformed to incline a projecting direction of the at least one resilient locking piece; and the at least one initial position holding projection is at a position different from the at least one resilient locking piece.

2. The connector assembly of claim 1, wherein the at least one resilient locking piece comprises two resilient locking pieces formed on the moving plate to project substantially parallel to a moving direction of the moving plate from two positions separated in a separating direction intersecting with the moving direction of the moving plate, both of the resilient locking pieces being resiliently deformable.

3. The connector assembly of claim 2, wherein the at least one initial position holding projection comprises two initial position holding projections are arranged at positions different from the resilient locking pieces in the separating direction of the resilient locking pieces and spaced apart in the same direction as the separating direction of the resilient locking pieces.

4. The connector assembly of claim 3, wherein the resilient locking pieces are arranged closer to end sides than the initial position holding projections in the separating direction of the resilient locking pieces.

5. The connector assembly of claim 3, wherein the resilient locking pieces are arranged substantially symmetrically and the initial position holding projections are arranged substantially symmetrically in the separating direction of the resilient locking pieces.

* * * * *